United States Patent [19]

Peterson et al.

[11] 4,425,083

[45] Jan. 10, 1984

[54] VELOCITY ACTUATED VALVE FOR A DOWNHOLE PUMP

[75] Inventors: Daniel G. Peterson, Los Angeles; John W. Erickson, Huntington Beach, both of Calif.

[73] Assignee: Kobe, Inc., City of Commerce, Calif.

[21] Appl. No.: 298,060

[22] Filed: Aug. 31, 1981

[51] Int. Cl.[3] ..... F04B 47/12

[52] U.S. Cl. ..... 417/56; 417/554

[58] Field of Search ..... 417/385–388, 417/226, 225, 377, 378, 390, 376, 391, 399, 401, 402, 546, 549–554, 56–58, 60

[56] References Cited

U.S. PATENT DOCUMENTS

| | | | |
|---|---|---|---|
| 1,836,876 | 12/1931 | Ricker | 417/56 |
| 1,845,181 | 2/1932 | Penrod | 417/56 X |
| 1,943,553 | 1/1934 | Ricker | 417/56 |

*Primary Examiner*—Eward K. Look

*Attorney, Agent, or Firm*—Norvell & Associates

[57] ABSTRACT

A downhole pump for a well is disclosed which includes a piston slidably disposed within a housing for pumping fluid from the well. The longitudinal axes of the piston and the housing extend in a generally vertical direction with respect to the surface of the well. A surface unit supplies a pulsating flow of fluid to the piston. A velocity actuated valve is formed in the piston and includes a ball which is spaced from an orifice by a bias. The bias holds the ball away from the orifice such that the valve is normally open. The flow of fluid through the velocity actuated valve during each fluid pulse creates a pressure differential which is resisted by the bias. When the pressure differential exceeds the force generated by the bias, the ball will seat in the orifice and close the valve to further fluid flow. The balance of the fluid pulse will be applied to the lower side of the piston and the piston moves upwardly within the housing, thereby pumping fluid from the well. At the end of each fluid pulse, the pressure will drop such that the bias forces the ball away from the orifice. Thus, the velocity actuated valve is opened and fluid can flow freely therethrough, to permit gravity to move the piston downwardly for the next power stroke and permits production fluid to enter the housing through a traveling valve and bottom discharge valve and flow through the velocity actuated valve to the upper side of the piston.

5 Claims, 6 Drawing Figures

VELOCITY ACTUATED VALVE FOR A DOWNHOLE PUMP

CROSS-REFERENCE TO RELATED APPLICATIONS

This application is related in subject matter to co-pending application Ser. No. 298,121, filed Aug. 31, 1981, entitled "SURFACE POWER UNIT FOR A DOWNHOLE PUMP" and co-pending application Ser. No. 298,122, filed Aug. 31, 1981, entitled "COMBINED SURFACE POWER UNIT AND VELOCITY ACTUATED VALVE FOR A DOWNHOLE PUMP," with each application being assigned to the same assignee as this application.

BACKGROUND OF THE INVENTION

1. Field of the Invention

The present invention relates in general to valves for subterranean well pumping units and in particular to a velocity actuated valve for a downhole pump.

2. Description of the Prior Art

Low pressure non-flowing wells account for the vast majority of the oil wells in the United States. There are various means available for pumping these non-flowing wells, including subsurface pumps which are electrically or hydraulically actuated. One problem which is common to both of these types of subsurface pumps is that a separate energy transmission path is required for supplying the actuating energy to the pump.

There have been several attempts to provide a rodless subsurface pump system which does not require a separate energy transmission path for activating the pump. Such a pump system typically includes a surface unit which is connected to the subsurface pump by a single fluid conduit. This surface unit activates the subsurface pump by applying pressure to the fluid in the conduit so as to compress a spring means in the pump and displace a slidable piston, thereby drawing fluid from the well into a pump chamber. When the surface unit releases the fluid pressure, the spring means of the downhole pump displaces the piston and lifts the fluid in the pump chamber into the fluid conduit. Such systems are disclosed in U.S. Pat. Nos. 2,058,455, 2,123,139, 2,126,880, and 2,508,609.

Several problems, however, are inherently associated with these pressure-activated subsurface pump systems. Since thousands of feet typically separate the surface unit from the downhole pump, considerable work is done compressing fluid in the conduit, ballooning the conduit, and moving fluid to compress the subsurface pump spring. The energy applied to the fluid in the fluid conduit system is much greater than the energy supplied to the subsurface pump. In these systems, considerably more energy is consumed in compressing the spring and ballooning the conduit than is used to lift the fluid. Thus, these systems are energy inefficient.

It would be desirable to provide a subsurface pump which has a relatively long stroke length such that more fluid could be produced for a given amount of energy input. Early subsurface pumps utilized strong helical compression springs as a means for lifting the fluid into the fluid conduit. Such springs severely limited the maximum stroke length which could be attained. Later subsurface pumps utilized an inert gas pressurized chamber which functioned as the spring means. When pressure was applied to the fluid conduit, a piston compressed gas within the chamber and, when the fluid pressure was relieved, the gas expanded to lift the fluid into the conduit. Such a subsurface pump is disclosed in U.S. Pat. No. 4,013,385.

SUMMARY OF THE INVENTION

The present invention relates to a velocity actuated valve for a downhole pump. The pump includes a generally cylindrical pump housing having a reciprocating piston member slidably disposed therein. The piston member includes an upper, larger diameter major head which is connected by a shaft to a lower, smaller diameter minor head. The velocity actuated valve is formed in the major head of the piston member and includes a ball which is normally spaced from an orifice by a spring. The longitudinal axes of the pump housing and piston member extend in a generally vertical direction with respect to the surface of a well in which the pump is positioned.

A surface unit is provided to supply a series of pulses of pressurized fluid to the downhole pump. When a pressurized pulse is supplied, fluid initially is applied to a lower side of the major head, passes through the velocity actuated valve to an upper side of the major head, and into an upper portion of the well to a production line. The flow of fluid through the velocity actuated valve creates a pressure differential thereacross which is resisted by the spring. When the velocity of the fluid through the valve creates a pressure differential which exceeds the force applied by the spring, the ball will seat on the orifice and close the valve to further fluid flow. Once closed, the valve will remain closed so long as the pressure differential exceeds the force generated by the spring. Because the velocity actuated valve is closed at the beginning of each power stroke applied by the surface unit, the remainder of the power stroke will cause the piston member to move upwardly in the pump housing and force fluid on the upper side of the major head to the surface. During the power stroke, fluid is drawn into the bottom of the pump housing through a standing valve from a production zone. At the end of each power stroke, the pressure generated drops, thereby permitting the spring to force the ball away from the orifice and open the valve. Fluid can thus flow through the major head of the piston member and allow gravity to retract the piston member for the next power stroke. As the piston member falls, production fluid enters the bottom of the housing through a traveling valve and bottom discharge valve and flows through the velocity actuated valve to be pumped to the production tubing of the well on the next power stroke.

The velocity actuated valve has the advantage of providing quick rise and fall times for the piston in the downhole pump for increased pumping capacity. When the pressurized fluid is applied, the valve closes immediately and the piston rises at a maximum rate. When the fluid pressure is reduced, the valve opens completely for a maximum rate of fall by the piston under the influence of gravity. The spring prevents the valve from closing due to the pressure differential created by the falling piston. Since the pump does no work as the piston falls, the piston fall time is at a minimum, and a maximum flow rate is achieved.

DESCRIPTION OF THE PREFERRED EMBODIMENTS

Figure 1:
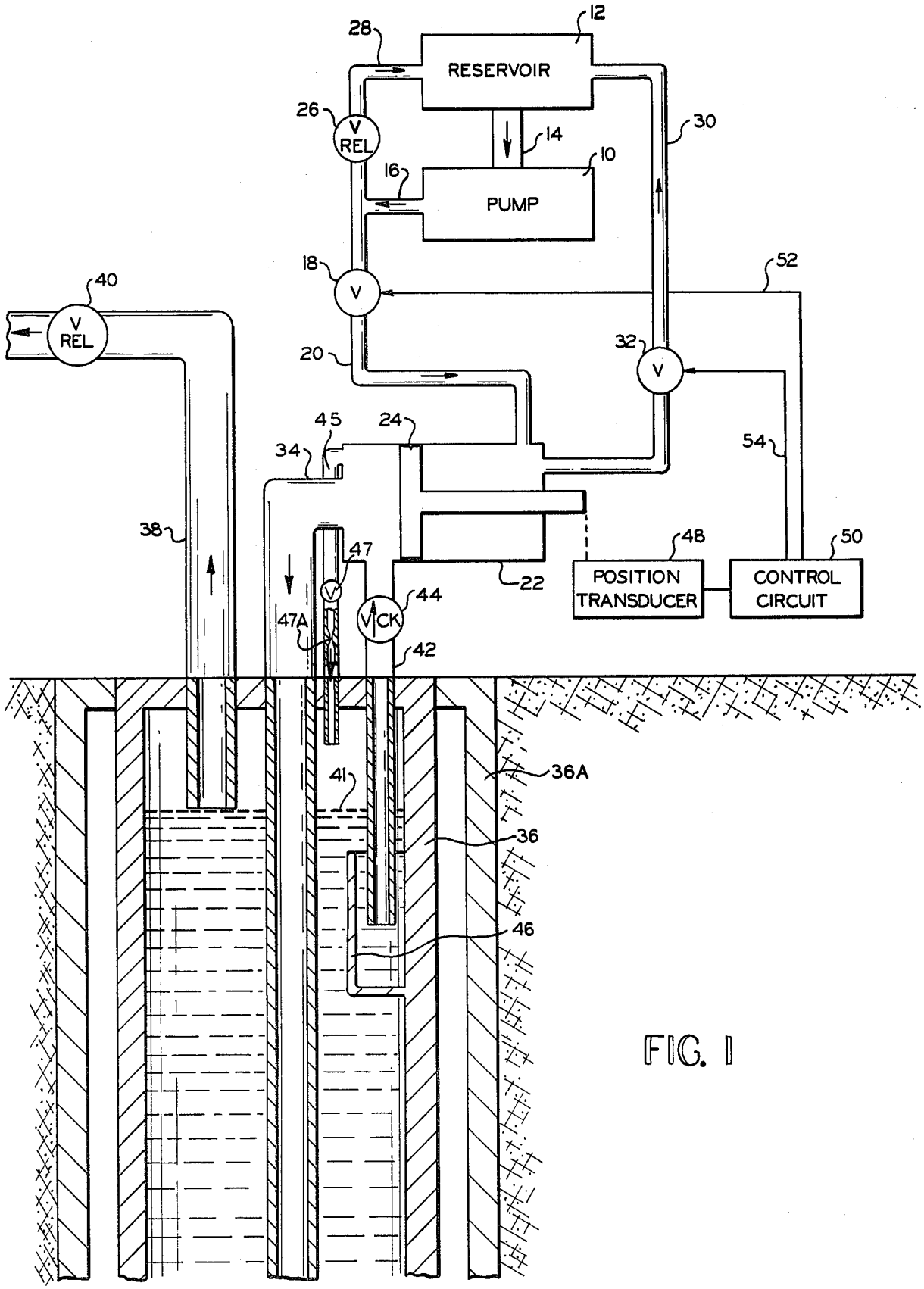
FIG. 1 is a sectional elevation view, partially shown schematically, of a surface power unit for use with the present invention.

Referring now to the drawings, there is illustrated in FIG. 1 a surface power unit for a downhole pump in accordance with the present invention. A pump means, such as a pump 10, receives fluid from a reservoir 12 through an intake line 14. The pump 10 is driven by a motor (not shown) and can be of the type which is conventional in the art. The pump discharges fluid under pressure into an output line 16. The fluid in the output line 16 can flow through either of two paths. The line 16 is connected to a charging line 20 through a valve 18. When the valve 18 is opened, the fluid can flow through the charging line 20 into a cylinder means, such as a cylinder 22, having a slidable piston 24 disposed therein. The piston 24 divides the cylinder 22 into a charging side, to which the charging line 20 is connected, and a power side.

The line 16 is also connected to relief line 28 through a valve 26. Fluid from the output line 16 can also flow, when the valve 26 is opened, through the relief line 28 back into the fluid reservoir 12. The charging side of the cylinder 22 is also in fluid communication with the reservoir 12 through a return line 30. A valve 32 controls the flow of fluid through the return line 30. Valves 18 and 32 can be separate valves or can be combined in a single valve.

The power side of the cylinder is connected to a power line 34. During a power stroke, fluid from the power side of the cylinder 22 is forced down the power line 34 to a downhole pump, as will be explained in greater detail below. The power line 34 is a means for supplying a series of pulses of fluid to the downhole pump. The power line 34 extends downwardly below the surface of the ground into a production tubing or conduit 36. The tubing 36 contains fluid and gas which has been pumped up by the downhole pump and is enclosed by a casing 36A. A standpipe 38 is provided for removing the pumped fluid from the tubing 36. A valve 40 regulates the flow of fluid through the standpipe 38 to a production line. Because a certain amount of gas will be pumped up with the fluid from the downhole pump, a gas pocket will form and the lower open end of the standpipe 38 will determine a fluid level 41 in the tubing 36.

The power side of the cylinder 22 communicates with the fluid contained in the tubing 36 through a return pipe 42. A valve 44 regulates the flow of fluid through the pipe 42. The pipe 42 is extended downwardly a distance sufficient to ensure that its lower open end is always below the fluid level 41 in the tubing 36. To prevent gas bubbles, which rise upwardly from the downhole pump, from entering the pipe 42, a liquid pocket is formed between one wall of the tubing 36 and an outwardly and upwardly extending baffle 46. The pipe 42 extends downwardly into this liquid pocket. Rising gas bubbles are deflected from entering the return pipe 42 by the baffle 46. Because the gas bubbles are lighter in weight than the surrounding pumped fluid, no gas can enter the pipe 42 so long as the fluid level in the well casing remains above the open end of the pipe 42.

A small amount of gas may be trapped in the cylinder 22 on the power side. A relatively small diameter vent line 45 is provided to remove such gas on each power stroke to an area above the fluid level 41 in the well casing. A check valve 47 in the vent line 45 prevents reverse flow of the gas and an orifice 47A controls the amount of flow.

Means responsive to the movement of the piston 24 in the cylinder 22 are provided for generating control signals representing the position of the piston 24 in the cylinder 22. In FIG. 1, a position transducer 48 monitors the position of the piston 24 within the cylinder 22. In the preferred embodiment of the invention, the position transducer 48 can be a conventional limit switch which alternately opens and closes when the piston 24 is fully extended and retracted respectively. The position transducer 48 is connected to a control circuit 50. The control circuit 50 generates control signals over a pair of lines 52 and 54 to the valves 18 and 32, respectively, in response to the changes in the position of the piston 24 in the cylinder 22. Although the valves 18 and 32 are electrically actuated in the preferred embodiment of the invention, it will be appreciated that any type of control means which regulates the action of the valves 18 and 32 in response to the movement of the piston 24 can be utilized. For example, the valve 18 could be sensitive to the pressure in the line 20.

In operation, the pump 10 continuously pumps fluid from the reservoir 12 into the output line 16. To charge the cylinder 22 for a power stroke, the valve 18 is opened so that fluid can flow through the charging line 20 into the charging side of the cylinder 22. At the same time, the valve 32 is closed so that no fluid can escape from the cylinder 22 through the return line 30 to the reservoir 12. The valve 26 in the relief line 28 can be a spring-loaded pressure check valve which permits fluid flow therethrough only when the pressure in the output line 16 exceeds a predetermined value. Normally, the relief pressure value on the valve 26 will be high enough to permit the piston cylinder 22 to fully stroke the downhole pump but low enough to prevent damage to the pump 10 caused by excessive back pressure.

When the pressure on the charging side of the piston 24 has built up to a level sufficient to overcome the pressure on the power side, the piston 24 will move through the cylinder 22 in a power stroke which forces fluid on the power side of the piston 24 down through the power line 34. The valve 44 can be a conventional check valve which permits fluid flow therethrough only from the tubing 36 into the cylinder 22. Thus, substantially all of the fluid on the power side of the piston 24 is forced down the power line 34 as the piston 24 is extended during its power stroke.

The fluid which is forced down the power line 34 causes a downhole pump to pump production fluid and gas upwardly into the tubing 36. As the pumping of production fluid continues, gas collects at the top end of the tubing 36 and becomes compressed. The compressed gas acts as a pressure charge on the production fluid in the tubing 36, causing the fluid to be discharged upwardly through the standpipe 38. The valve 40 in the standpipe 38 can be a spring-loaded pressure check valve so as to maintain a predetermined amount of back pressure on the fluid which remains in the tubing 36.

When the piston 24 has completed its power stroke in the cylinder 22, the limit switch of the position transducer 48 so indicate to the control circuit 50. In response thereto, the control circuit 50 generates a signal over the line 52 which causes the valve 18 to be closed. Simultaneously, the control circuit 50 generates a signal over a line 54 which causes the valve 32 to be opened. Thus, the flow of pressurized fluid from the output line 16 is prevented from passing through the charging line 20 into the cylinder 22. The fluid pressure in the output line 16 builds until it exceeds the relief value of the pressure check valve 26. At that point, fluid will flow through the valve 26 and the relief line 28 into the reservoir 12. The pump 10 can thus operate continuously without danger of causing damage.

When the valve 18 is closed at the end of the power stroke of the piston 24, fluid pressure is removed from the charging side of the cylinder 22. The pressure charge of the gas in the tubing 36 will cause the fluid contained in the casing to rise upwardly through the return pipe 42 and the one-way check valve 44 into the power side of the cylinder 22. Such fluid pressure forces the piston 24 to be moved toward the charging side of the cylinder 22. The fluid contained in the charging side of the cylinder 22 is rapidly discharged therefrom through the return line 30 to the reservoir 12, since the valve 32 has been closed. Thus, the piston 24 is rapdily returned by the pressurized fluid from the tubing 36 to the other end of the cylinder 22 for the next power stroke. When the piston 24 reaches the end of the cylinder, the position transducer 48 will indicate to the control circuit 50 to generate a signal over the line 52 instructing the valve 18 to open and a signal over the line 54 instructing the valve 32 to close.

From the foregoing description of the surface power unit, it can be seen that a pulsating flow of pressurized fluid is supplied through the power line 34 to the downhole pump. Fluid flow through the power line 34 is permitted in a single direction only, that direction being downwardly to the downhole pump. In other words, when the piston 24 completes a power stroke and is retracted in preparation for the next power stroke, production fluid from the tubing 36 flows through the return pipe 42 and replenishes the power side of the piston cylinder 22, thereby preventing any suction which might cause fluid in the power line 34 to flow upwardly back into the piston cylinder 22. Such one-way flow of fluid is critical to the efficient operation of both the surface power unit and the downhole pump.

It will also be appreciated that the fluid circuit utilized to drive the piston 24 during a power stroke is independent of the fluid circuit utilized to drive the downhole pump. All of the fluid pumped through the pump 10 either returns directly to the reservoir 12 or passes through the charging side of the piston cylinder 22 before returning to the reservoir 12. Similarly, the fluid in the power side of the cylinder 22, which is forced down the power line 34 in pulsating fashion, is obtained from pumped fluid in the tubing 36. Such independent fluid circuits permit the efficient application of fluid pulses without contamination from the production fluid.

Figure 2:
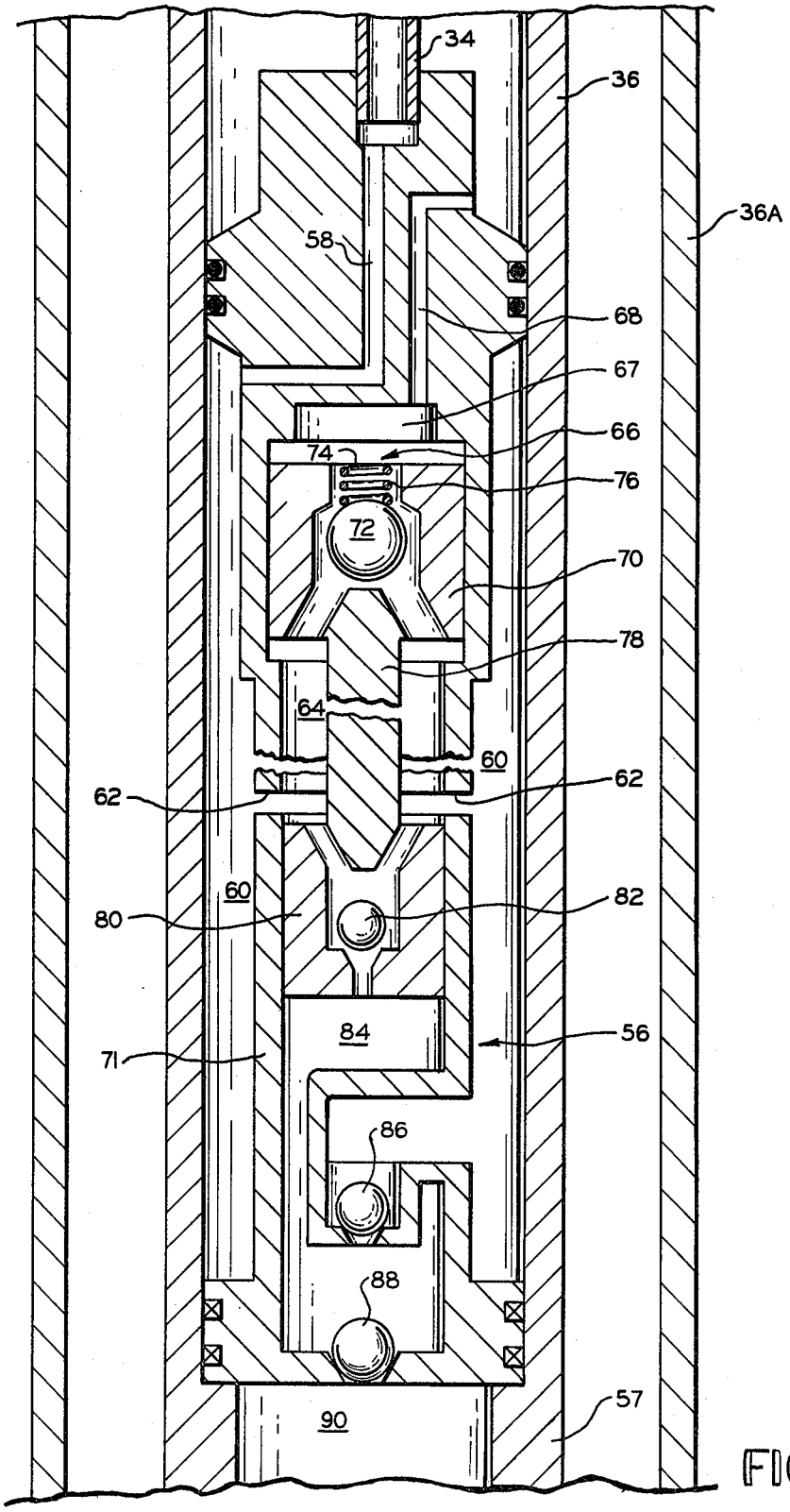
FIG. 2 is a sectional elevation view of a downhole pump and velocity actuated valve in accordance with the present invention which can be used in conjunction with the surface power unit of FIG. 1.

Referring now to FIG. 2, there is illustrated a downhole pump having a velocity actuated valve in accordance with the present invention. The downhole pump includes a generally cylindrical pump housing, indicated at 56, and a reciprocating piston means slidably disposed therein. The construction and operation of the piston means will be described in detail below. The lower end portion of the pump housing 56 engages an inwardly-extending shoulder 57 of the tubing 36. The pump housing 56 is firmly held in position during the pumping operation by its own weight and by the weight and pressure of the pumped fluid in the tubing 36 and the power line 34.

The pulsating pressurized fluid from the power line 34 enters the pump housing 56 through an inlet passage 58. The inlet passage 58 communicates with an annular chamber 60 formed between the wall of the lower portion of the pump housing 56 and the tubing 36. A plurality of orifices 62 are formed in an outer wall 71 of the pump housing 56 to provide for fluid communication between the annular chamber 60 and a chamber 64 internal to the pump housing. The internal chamber 64 communicates through a velocity actuated valve, indicated generally at 66, and a chamber 67 with an outlet passage 68. The outlet passage 68 permits the production fluid which is pumped from the well to flow upwardly out of the pump housing 56 and into the tubing 36.

The velocity actuated valve 66 is formed in a major diameter head 70 portion of the piston means and includes a ball 72 which is spaced from an orifice 74 by a spring 76. The spring 76 holds the ball 72 away from the orifice 74 such that the velocity valve 66 is normally open and fluid can flow freely therethrough between the chamber 64 and the chamber 67. A shaft 78 connects the major head 70 of the piston means with a smaller diameter minor head portion 80. The minor head 80 of the piston means has a check valve 82 formed therein to permit the one-way flow of fluid from a production chamber 84 formed in the lower portion of the pump housing to the chamber 64. Another check valve 86 permits the one-way flow of fluid from the production chamber 84 to the annular chamber 60. A standing valve 88 is provided in the lower end of the pump housing 56 and allows well fluid located in a production zone 90 to flow into the production chamber 84.

OPERATION

The surface power unit applies a series of pulses of pressurized fluid through the power line 34 to the downhole pumping unit. The pulsating fluid initially passes through the inlet passage 58, the chamber 60, the orifices 62, the chamber 64, and through the velocity valve 66. The flow of fluid through the velocity valve 66 creates a pressure differential thereacross which is resisted by the spring 76. When the velocity of the fluid through the valve 66 creates a pressure differential which exceeds the force applied by the spring 76, the ball 72 will seat in the orifice 74 and close the valve 66 to further fluid flow. It has been found desirable to provide a spring 76 which will restrain the ball 72 from seating in the orifice 74 until the pressure differential across the valve 66 exceeds a preset limit. Once the velocity valve 66 is closed, fluid pressure builds rapidly in the internal chamber 64. The valve 66 will remain closed so long as the pressure differential is greater than the force generated by the spring 76.

The velocity valve 66 will close at the beginning of each power stroke pulse initiated by the surface power unit. Thus, when the valve 66 does close, the balance of the power stroke pulse will cause the fluid pressure to rise in the internal chamber 64. Such fluid pressure will act on both the major head 70 and minor head 80 of the piston means, tending to move the heads in opposite directions. However, since the major head 70 of the piston means has more surface area exposed to the accumulated fluid pressure in the internal chamber 64 than the minor head 80, the piston means will rise upwardly within the pump housing 56. As the piston means rises upwardly, fluid contained in the region above the major head 70 and in the outlet passage 68 will be pumped upwardly towards the surface. At the same time, the check valve 82 in the minor head 80 will close, creating a suction in the production chamber 84. Well fluid contained in the production zone 90 below the pump housing 56 will be drawn upwardly through the standing valve 88 into the production chamber 84.

When the power stroke pulse of the surface unit is completed, the fluid pressure in the power line 34 will drop. Such pressure drop permits the spring 76 to push the ball 72 away from the orifice 74. Thus, the velocity valve 66 is opened and fluid is permitted to flow freely therethrough. The weight of the piston means will cause it to fall downwardly through the pump housing 56. As the piston means drops downwardly, the check valves 82 and 86 open to permit fluid which has been drawn into the production chamber 84 to flow upwardly therethrough into the internal chamber 64. The standing valve 88 prevents fluid in the production chamber 84 from returning to the production zone 90 as the piston means falls downwardly on its re-charging stroke. To ensure that the piston means falls downwardly as quickly as possible, the fluid contained in the production chamber 84 can also flow through the check valve 86 into the cylindrical chamber 60. Such an arrangement as described herein allows the piston means to travel downwardly through the pump housing 56 rapidly without requiring the application of external pressure to reposition the piston means for the next power stroke.

Figure 3:
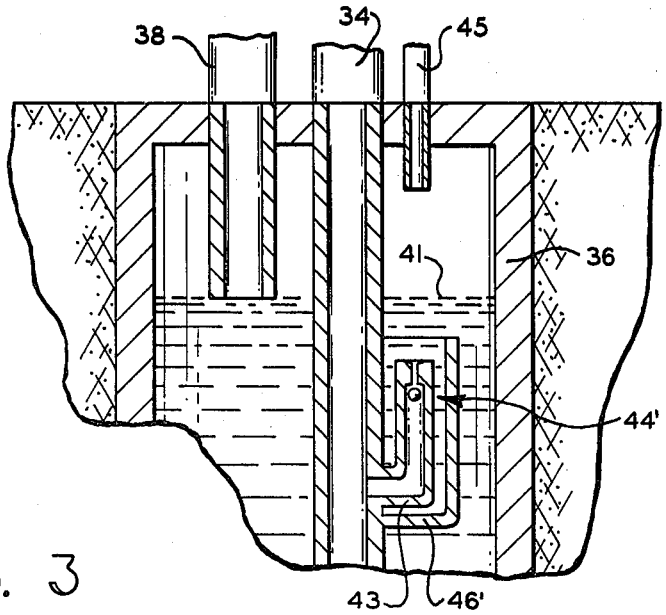
FIG. 3 is a sectional elevation view of the upper portion of the production tubing of FIG. 1 showing an alternate embodiment of the connection between the surface power unit and the downhole pump.

There is shown in FIG. 3, an alternate embodiment of the connection between the surface power unit of FIG. 1 and the downhole pump of FIG. 2. The return pipe 42 shown in FIG. 1 has been replaced by an elbow pipe 43 connected at one end through the side of the power line 34 and terminating at the other end in an upstanding opening provided with a check valve 44' which functions in the same manner as the valve 44 of FIG. 1. The elbow 43 is positioned in a pocket formed by an outwardly and upwardly extending flange portion 46' attached to the power line 34. The flange 46' functions to deflect gas bubbles in a manner similar to the flange 46 of FIG. 1.

FIRST ALTERNATE EMBODIMENT

Figure 4:
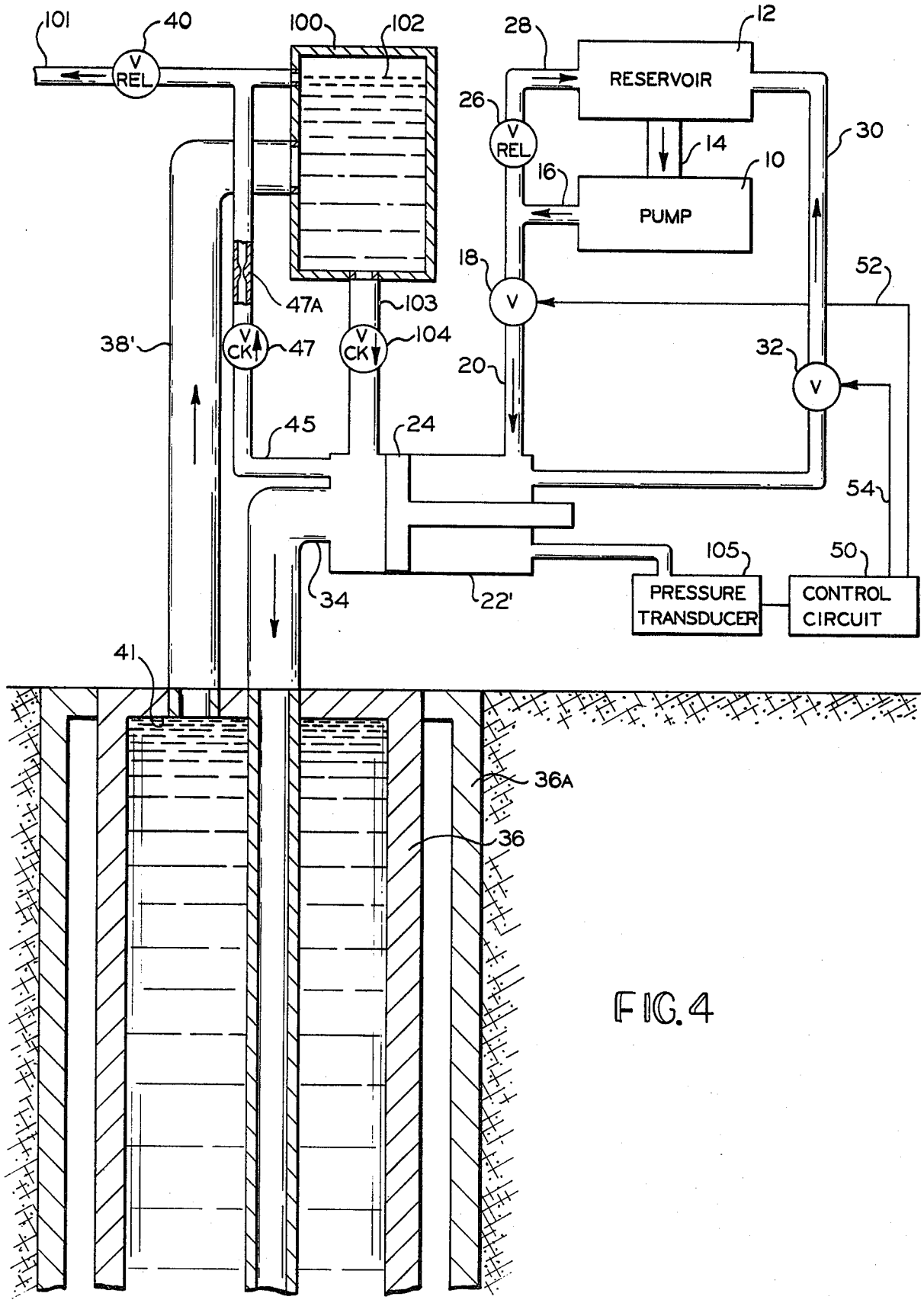
FIG. 4 is a sectional elevation view, partially shown schematically, of a first alternate embodiment of the surface power unit shown in FIG. 1.

There is shown in FIG. 4, a first alternative embodiment of the surface power unit shown in FIG. 1. Like elements are identified with the same reference numerals as shown in FIG. 1. The return pipe 42, the valve 44 and the baffle 46 shown in FIG. 1 have been eliminated. Also, the gas chamber in the upper portion of the tubing 36 has been eliminated and the lower end of a standpipe 38' and the fluid level 41 have moved to the top of the well head.

The surface power unit includes an energy storage cylinder or tank 100 having the upper end of the standpipe 38' connected approximately equidistant between the upper and lower ends thereof. A flow line 101 is connected to the tank 100 above the standpipe 38' at the fluid level 102 in the tank. The relief valve 40 is connected in the line 101 to function in a manner similar to the valve 40 of FIG. 1. The vent line 45, containing the check valve 47 and the orifice 47A, is connected between the power side of a cylinder 22' and the connection of the flow line 101 to the tank 100. The bottom of the tank 100 is connected to the power side of the cylinder 22' through a line 103 having a check valve 104 therein. The transducer 48 of FIG. 1 has been replaced by a pressure transducer 105 connected to the charging side of the cylinder 22'. Such a system permits the use of a standard sucker rod well head.

In operation, the pump 10 continuously pumps fluid from the reservoir 12 into the output line 16 to charge the cylinder 22' through the valve 18 while the valve 32 is open. The piston 24 will move in a power stroke to force the fluid on the power side. of the piston down through the power line 34. The fluid which is forced down the power line 34 causes the downhole pump to pump production fluid and gas upwardly into the tubing 36 and discharge into the tank 100 through the standpipe 38'. The fluid in the tank 100 is forced out into the flow line 101 through the check valve 40. The check valve 47 blocks fluid flow from the line 101 to the power side of the cylinder 22', but permits the escape of any gas trapped on the power side of the piston 24.

When the piston 24 has completed its stroke, the pressure in the charging side of the cylinder 22' builds to a predetermined maximum value which is sensed by the transducer 105. The transducer 105 signals the control circuit 50 which switches the valves 18 and 32. The fluid pressure from the pump 10 is removed from the charging side of the piston 24 and the fluid pressure of the fluid in the tank 100 will cause fluid flow through the valve 104 to force the piston toward the charging side. The fluid contained in the charging side of the cylinder 22' is discharged therefrom through the line 30 and the valve 32 to the reservoir 12.

Figure 5:
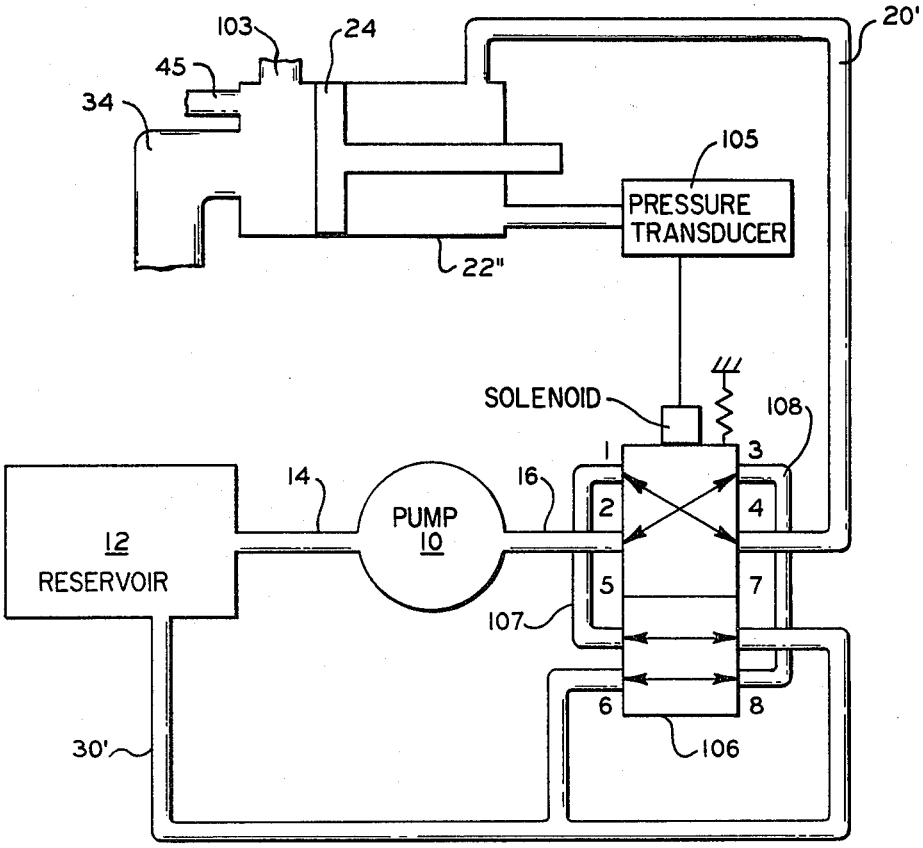
FIG. 5 is a schematic block diagram of an alternate embodiment of the connections among the cylinder, pump and reservoir shown in FIG. 4.

In FIG. 5 there is shown an alternate embodiment of the connections among the cylinder, pump and reservoir shown in FIG. 4. The inlet of the pump 10 is connected to the reservoir 12 by the line 14 as shown in FIG. 4. The line 16 is connected between the pump outlet and a port 106-2 of a four-way valve 106. A port 106-4 is connected to the charging side of a cylinder 22'' by a line 20'. A port 106-6 and a port 106-7 are connected to the reservoir 12 by a line 30'. A port 106-1 is connected to a port 106-5 by a line 107 and a port 106-3 is connected to a port 106-8 by a line 108. The pressure transducer 105 is connected to the solenoid of the valve 106.

The valve 106 is shown in the de-activated position. During the power up portion of the pumping cycle, the transducer 105 activates the solenoid to switch the valve 106. The pump supplies pressurized fluid to the cylinder 22'' through the line 16, the port 106-2, the port 106-4, and the line 20'. The line 30' is disconnected since the ports 106-6 and 106-7 are connected in the valve. When the maximum predetermined pressure is reached, the transducer de-activates the solenoid and the valve is spring biased to return to the position shown. Fluid can flow from the cylinder 22'' through the line 20'', the port 106-4, the port 106-1, the line 107, the port 106-5, the port 106-7, and the line 30' to the reservoir 12. Also, the pump 10 is connected to the reservoir 12 through the port 106-2, the port 106-3, the line 108, the port 106-8, port 106-6, and the line 30'. Such a system reduces the number of connections to the cylinder 22'' and eliminates one of the valves 18 and 32.

SECOND ALTERNATE EMBODIMENT

Figure 6:
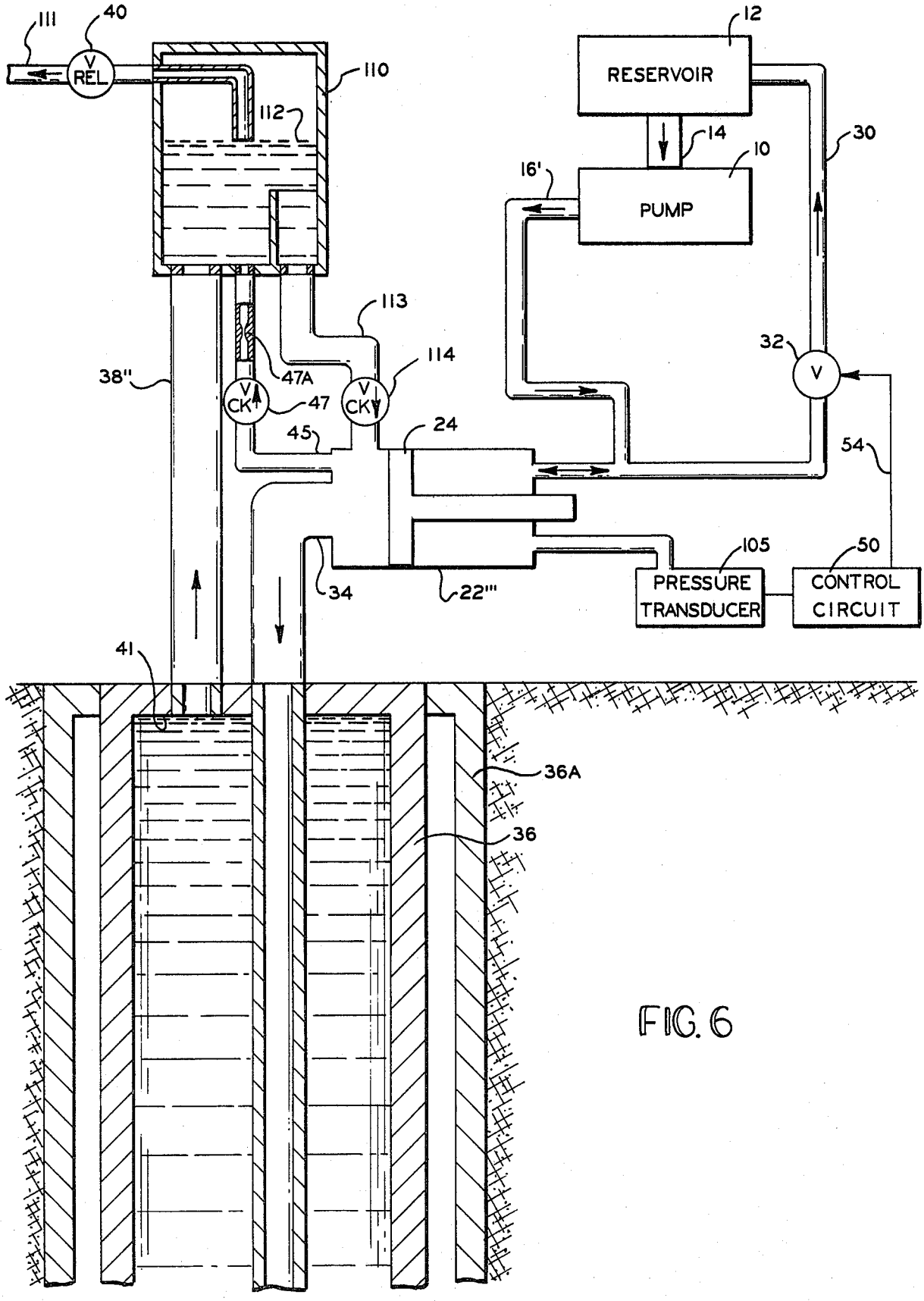
FIG. 6 is a sectional elevation view, partially shown schematically, of a second alternate embodiment of the surface power unit shown in FIG. 1.

There is shown in FIG. 6 a second alternate embodiment of the surface power unit shown in FIG. 1. Like elements are identified with the same reference numerals as in FIG. 1. The valve 18, the line 20, the valve 26, the line 28, and the line 52 shown in FIG. 1 have been eliminated from the pumping circuit. The output of the pump 10 is connected directly to the charging side of a cylinder 22''' by an output line 16''. The return pipe 42, the valve 44, the baffle 46 and the gas chamber in the upper portion of the tubing 36 shown in FIG. 1 also have been eliminated. The lower end of a standpipe 38'' and the fluid level 41 have been moved to the top of the well head.

The surface power unit includes an energy storage cylinder or tank 110 having the upper end of the standpipe 38'' connected to the bottom end thereof. A flow line 111 is connected to and extends into the tank 110 in the upper end thereof to define a fluid level 112 at the lower end of the line 111. The relief valve 40 is connected in the line 111 to function in a manner similar to the valve 40 of FIG. 1. The vent line 45, containing the check valve 47 and the orifice 47A, is connected between the power side of the cylinder 22''' and the lower end of the tank 110. The lower end of the tank is also connected to the power side of the cylinder 22''' through a line 113 having a check valve 114 therein. The position transducer 48 of FIG. 1 has been replaced by a pressure transducer 105 connected to the charging side of the cylinder 22. Such a system permits the use of a standard sucker rod well head. Furthermore, the modifications to the elements connected to the charging side of the cylinder 22''' could be incorporated in the surface power units shown in FIGS. 1 and 4 or the modifications to the elements connected to the power side of the cylinder could be incorporated in the surface power units shown in FIGS. 1 and 4.

In operation, the pump 10 continuously pumps fluid from the reservoir 12 into the output line 16' to charge the cylinder 22''' when the valve 32 is open and into the return line 30 when the valve 32 is closed. When the valve 32 is open, the piston 24 will move in a power stroke to force the fluid on the power side of the piston down through the power line 34. The fluid which is forced down the power line 34 causes the downhole pump to pump production fluid and gas upwardly into the tubing 36 and discharge into the tank 110 through the standpipe 38''. The fluid in the tank 110 is forced out into the flow line 111 through the relief valve 40. The check valve 47 blocks fluid flow from the tank 110 to the power side of the cylinder 22''', but permits the escape of any gas trapped on the power side of the piston 24.

When the piston 24 has completed its stroke, the pressure in the charging side of the cylinder 22''' builds to a predetermined maximum valve which is sensed by the transducer 105. The transducer 105 signals the control circuit 50 which switches the valve 32 closed. Now the pump 10 and the charging side of the cylinder 22''' are connected to the reservoir through the line 30, thus, the energy required during this part of the cycle will be minimized. The fluid pressure in the tank 110 will cause fluid flow through the valve 114 to force the piston toward the charging side.

The pressure transducer 105 is the equivalent of the position transducer 48. The pressure transducer 105 generates a signal at the predetermined maximum pressure limit which occur at the end of the stroke of the piston 24 which is sensed by the position transducer 48.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A downhole pump for pumping production fluid from a subterranean well production zone comprising: a pump housing for positioning in a production zone of the well; piston means vertically slidably disposed within said pump housing; inlet means formed in said housing for fluid communication between a source of pressurized fluid pulses and one side of said piston means; outlet means formed in said housing for fluid communication between another side of said piston means and a portion of the well above said pump housing; an orifice formed in said piston means for fluid communication between said inlet means and said outlet means; fluid conduit means communicating between the lower side of said piston means and said production zone; a first check valve closing said fluid conduit means in response to the pressurized fluid pulses; a second check valve disposed in said fluid conduit means between said first check valve and said production zone; said second check valve being closed by downward movement of said piston means; and closure means responsive to fluid flow through said orifice for closing said orifice when a predetermined pressure differential across said piston means is exceeded, whereby said pressurized fluid pulses move said piston means upwardly in said housing in a power stroke to pump production fluid from said production zone to said upper portion of the well.

2. The downhole pump according to claim 1 including an annular chamber formed between an outer wall of said pump housing and an inner wall of a production conduit in the well and a check valve positioned in said inlet side of said housing for fluid communication between said housing and said chamber during said return stroke of said piston means.

3. A downhole pump for puming production fluid from a subterranean well comprising: a pump housing located in a production zone of the well; piston means vertically slidably disposed within said housing dividing said housing into an inlet side and an outlet side; an orifice formed in said piston means for fluid communication between said inlet side and said outlet side; a fluid inlet formed in said housing for fluid communication between said inlet side and a source of pressurized fluid pulses; a fluid outlet formed in said housing for fluid communication between said outlet side and a portion of the well above said pump housing; said piston means including an upper head means attached to a lower head means; a downwardly facing surface of said upper head means and an upwardly facing surface of said lower head means cooperating with an inner wall of said pump housing to define a chamber; said fluid inlet being in fluid communication between said source of pressurized fluid pulses and said chamber; said orifice being formed in said upper head means and being in fluid communication between said chamber and said fluid outlet; and closure means including a valve head positioned adjacent an opening of said orifice on said inlet side of said piston means and means for normally biasing said valve head away from said opening; said valve head being responsive to a predetermined pressure differential across said orifice generated by said pressurized fluid pulses for closing said orifice whereby said piston means is moved upwardly on a power stroke by said pressurized fluid pulses to pump the production fluid and returns by gravity between said pressurized pulses.

4. The downhole pump according to claim 3 including a check valve in said lower head means for fluid communication within said chamber during a return stroke of said piston means.

5. The downhole pump according to claim 3 including an annular chamber formed between an outer wall of said pump housing and an inner wall of a production conduit in the well and a check valve positioned in said inlet side of said housing for fluid communication between said housing and said chamber during said gravity return stroke of said piston means.

* * * * *